United States Patent [19]

Grave

[11] Patent Number: 4,720,889

[45] Date of Patent: Jan. 26, 1988

[54] PERIMETER SEAL STRUCTURE FOR A CLEANING HEAD

[76] Inventor: Dale L. Grave, 125 Queensland Ln., North, Plymouth, Minn. 55447

[21] Appl. No.: 42,020

[22] Filed: Apr. 24, 1987

[51] Int. Cl.[4] ..... A47L 11/30

[52] U.S. Cl. ..... 15/322; 15/420; 15/421

[58] Field of Search ..... 15/321, 322, 420, 421

[56] References Cited

U.S. PATENT DOCUMENTS

| | | | |
|---|---|---|---|
| 2,240,005 | 4/1941 | Moyer | 15/322 X |
| 2,243,935 | 6/1941 | Williamson | 15/322 X |
| 2,292,435 | 8/1942 | Crites | 15/322 X |
| 3,195,166 | 7/1965 | Wisner | 15/322 X |
| 3,195,167 | 7/1965 | Wayne | 15/322 |
| 3,840,935 | 10/1974 | Fitzgerald | 15/322 |
| 3,958,298 | 5/1976 | Cannan | 15/322 |
| 4,488,330 | 12/1984 | Grave | 15/322 |

FOREIGN PATENT DOCUMENTS

| | | | |
|---|---|---|---|
| 2159696 | 12/1985 | United Kingdom | 15/322 |

*Primary Examiner*—Chris K. Moore

*Attorney, Agent, or Firm*—Leo Gregory

[57] ABSTRACT

A cleaning head for a hard or a yielding surface cleaning machine having a cleaning and a suction chamber therein, the cleaning head having an annular seal overlying the bottom edge portion thereof, the cleaning head having an incoming jet stream of aerated cleaning fluid, the seal having a predetermined density, porosity or particularly defined air passages to provide a controlled accessability of air into the cleaning chamber in operative association therein with the incoming stream of cleaning fluid.

11 Claims, 14 Drawing Figures

FIG. 10
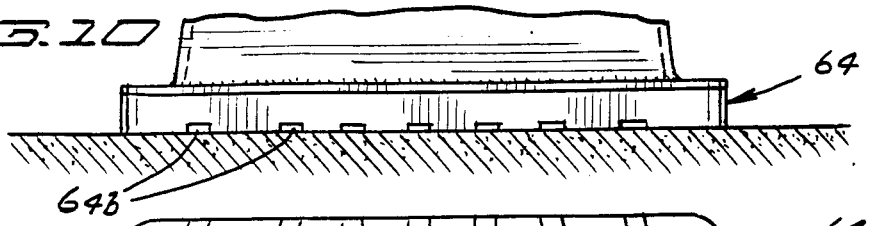
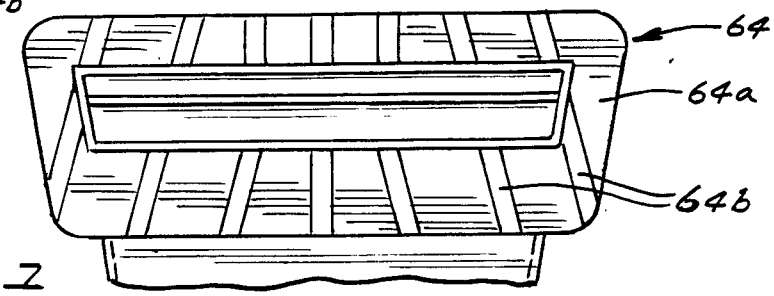
FIG. 11
FIG. 12
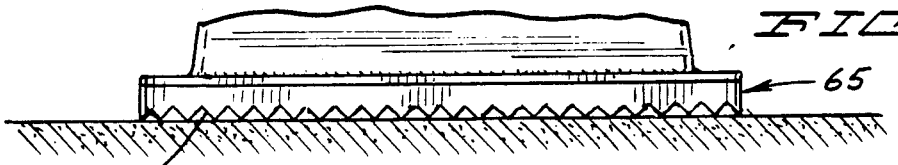
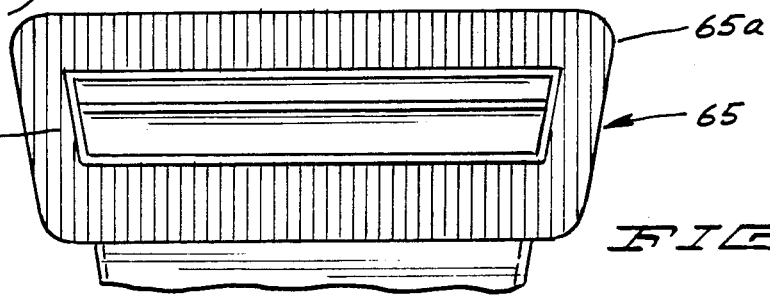
FIG. 13
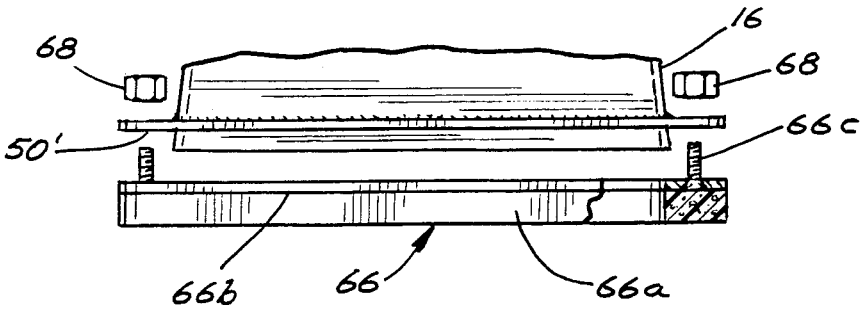
FIG. 14

PERIMETER SEAL STRUCTURE FOR A CLEANING HEAD

BACKGROUND OF THE INVENTION

1. Field of Invention.

This invention relates to the accessability of air and of cleaning fluid and the control thereof within the cleaning head of a surface material cleaning apparatus and the engagement thereof with a surface to be cleaned.

2. Brief Description of the Prior Art.

There maybe some passage of air between the bottom of a cleaning head and the surface engaged which is being cleaned. There is not known to be any peripheral structure of the bottom wall or bottom surface portion of a cleaning head which is intended to control the admission of air from the atmosphere into the cleaning chamber of the cleaning head in connection with the application of cleaning fluid.

It is desirable to have a control as to the admission of air passing into said cleaning chamber in connection with the passage of cleaning fluid and it is desirable also to predetermine direction of flow of the air which is admitted.

SUMMARY OF THE INVENTION

In connection with a surface cleaning apparatus, it is an object to have a cleaning head for cleaning both hard and yielding surfaces which permits a control of the access of air from the atmosphere into the cleaning chamber of the cleaning head.

It is another object of this invention to provide for exchangeable perimeter seal members for cleaning heads, adapting the seals to the character of the surfaces to be cleaned.

It is a further object of this invention to provide a perimeter seal for a cleaning head which causes a directional access for the flow of air, the seal having well defined air passages as in the bottom surface portion thereof.

It is also an object of this invention to provide a perimeter seal as indicated having a body structure such that the porosity thereof may be determined to control the access of air therethrough into the cleaning chamber of the cleaning head in combination with the air, accompanying the inflow of the cleaning fluid and being relative to the porosity of the surface material being cleaned.

These and other objects and advantages of the invention will be set forth in the accompanying description made in connection with the accompanying drawings in which like reference characters refer to similar parts throughout the several views.

BRIEF DESCRIPTION OF THE DRAWINGS

FIG. 10 is a view similar to that of FIG. 6 showing a modification;

FIG. 11 is a bottom plan view of the structure of FIG. 10;

FIG. 12 is another modification of the structure of FIG. 6;

FIG. 13 is a bottom plan view of the structure of FIG. 12; and

FIG. 14 is a broken view in side elevation of a modification of the peripheral portion of the cleaning head of the invention herein.

DESCRIPTION OF A PREFERRED EMBODIMENT

Figure 1:
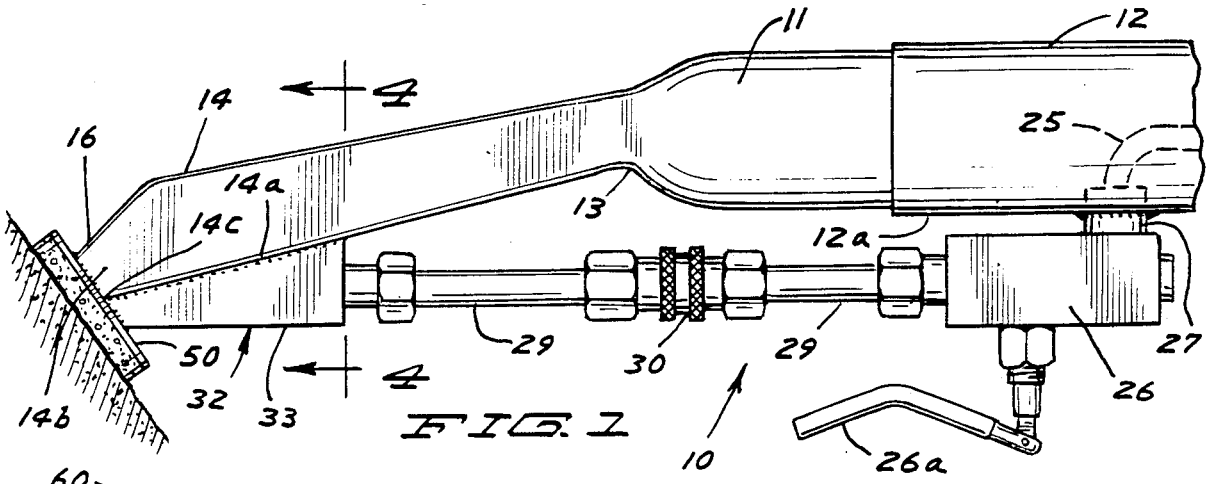
FIG. 1 is a broken view in side elevation.
Figure 2:
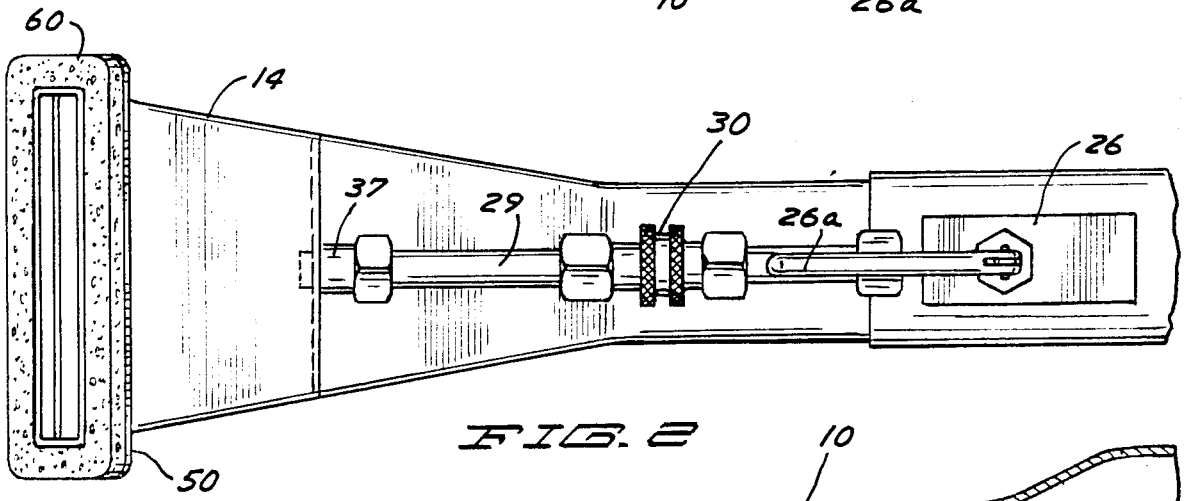
FIG. 2 is a broken bottom plan view.
Figure 3:
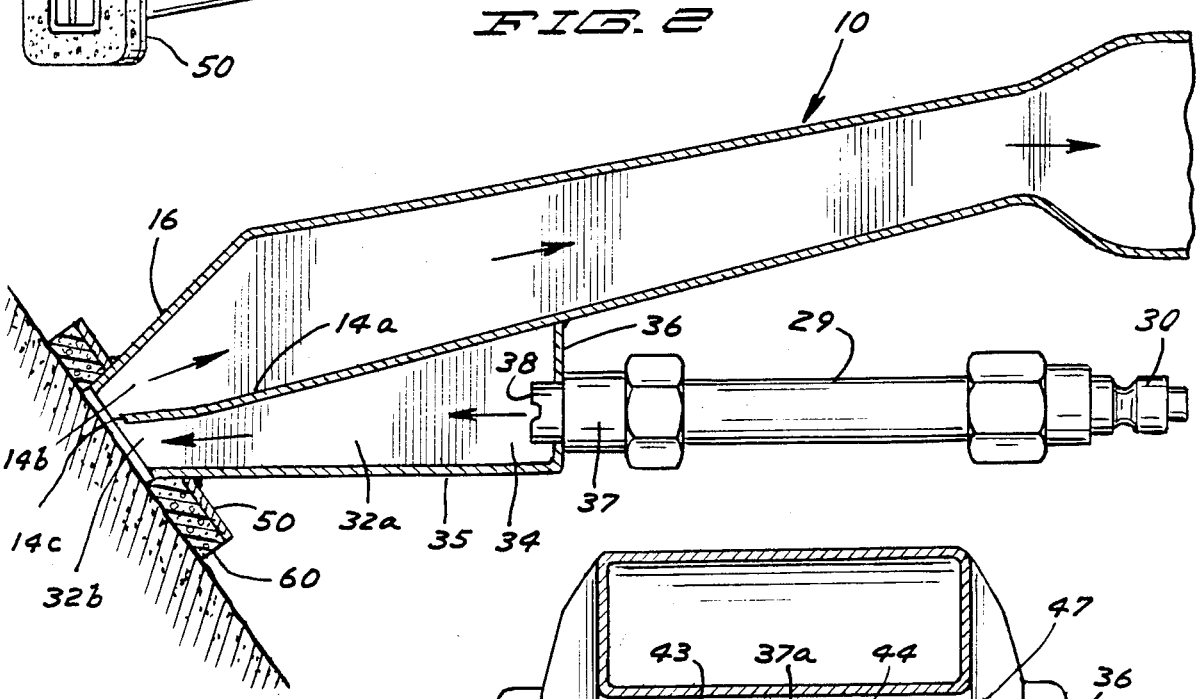
FIG. 3 is a view similar to that of FIG. 1 in vertical longitudinal section.

Referring to the drawings, the cleaning head or nozzle structure of the invention herein is indicated generally by the reference numeral 10. The remainder of the cleaning apparatus with which the nozzle is intended to be connected for use is not shown, it is referred to incidentally and forms no part of the present invention.

More specifically, as will be described, the invention herein relates to the structure of the lower or bottom wall portion of the head portion of the nozzle. The nozzle and structure relating to said lower or bottom wall portion will first be described.

The nozzle structure 10 comprises a tubular housing portion 11 which at its upper end slips into a sleeve 12 having an air sealed fit therein. Said tubular housing reduces as at 13 and extends forwardly as a flared portion 14 substantially rectangular in cross section and having a tapered terminal nose portion 16.

Extending through said sleeve 12 is a fluid line 25 running into a flow control valve 26 secured to the underside **12*a* of said sleeve by a coupling 27. Said valve has a manually operable flow modulating handle or control 26*a*. Extending from said valve 26 is a continuation of the line 25 shown as line 29. Intermediate said line 29 is a quick disconnect pipe connector 30** which is a commonly used item.

Underlying the forward portion of said member 14 is a channel member 32 having side walls 33 and 34, a bottom wall 35 and a rear end wall 36 through which is disposed the terminal end 37 of said line 29 which has a forwardly projecting jet 38 extending into a chamber **32*a*** hereinafter described.

The wall **14*a* of said nozzle 14 is a common wall between said nozzle and the chamber 32*a* formed within said member 32. Said nozzle has an end outlet 14*b* and said channel member 32 has an end outlet 32*b*. Said outlets are seen to have a recessed terminal portion 14*c* of said wall 14*a*** as a separating or partition member therebetween.

Figure 4:
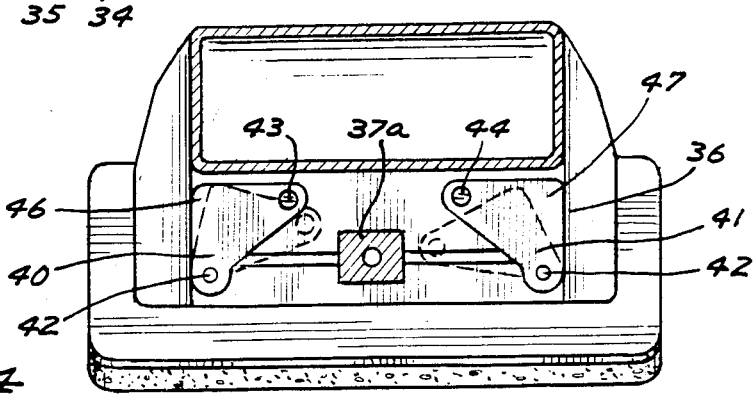
FIG. 4 is a sectional view taken on line 4—4 of FIG. 1, as indicated.

Said rear wall 36 as shown in FIG. 4, has a pair of adjustable vent plates 40 and 41 pivotally secured by screws 42 and the same are pivoted by the knobs 43 and 44 to adjust said vents to control the passage of air through the openings 46 and 47. Said air comingles with the incoming stream of cleaning fluid through the jet 38.

Secured to adjacent the outer end terminal portion 16 of said nozzle 14 is a plate member 50 rectangular in plan and which extends as a flange about said terminal portion of said nozzle and is suitably secured thereto. The terminal portion **16*a* of said nozzle is here shown extending through said plate member forming a shoulder. The bottom face of surface 52 of said plate member 50** will be of such a character as to accept the placement and the removal of various adhesive coated seal members thereto as will be described.

The line 25–29 is used to supply a cleaning fluid into the chamber 32*a* to be applied to engage the surface to be cleaned. The nozzle 14 and the chamber 14*b* therein form a part of the vacuum system for withdrawal or recovery of the cleaning fluid together with the contaminants and soil removed from the surface cleaned. The vacuum pump with which said chamber 14*b* has operative communication is not here shown but is such as described in applicant's U.S. Pat. No. 4,466,155 dated 8/21/84.

The basic purpose herein is to provide controlled admission of air to both the cleaning and vacuum chambers.

The controlled entrance of air into the cleaning chamber in balance in combination with the entry of air through the adjustable ports 46 and 47 which accompanies the inflow of cleaning fluid makes for a very effective dispersal of the cleaning fluid into engagement with the underlying surface material to be cleaned.

The entry of air into the vacuum chamber from the perimeter of the nozzle supports the recovery action of the vacuum in the chamber 14*b* in withdrawing the cleaning fluid and the soil and contaminants picked up by its cleaning action, the same being passed to an accumlulator carried by the associated cleaning apparatus not here shown.

The access of air into the chambers of the nozzle 14 is controlled by the use of appropriate seal or pad members which are disposed about the shoulder 16*a* and removably secured to the bottom surface 52 of the flange 50.

Figure 5:
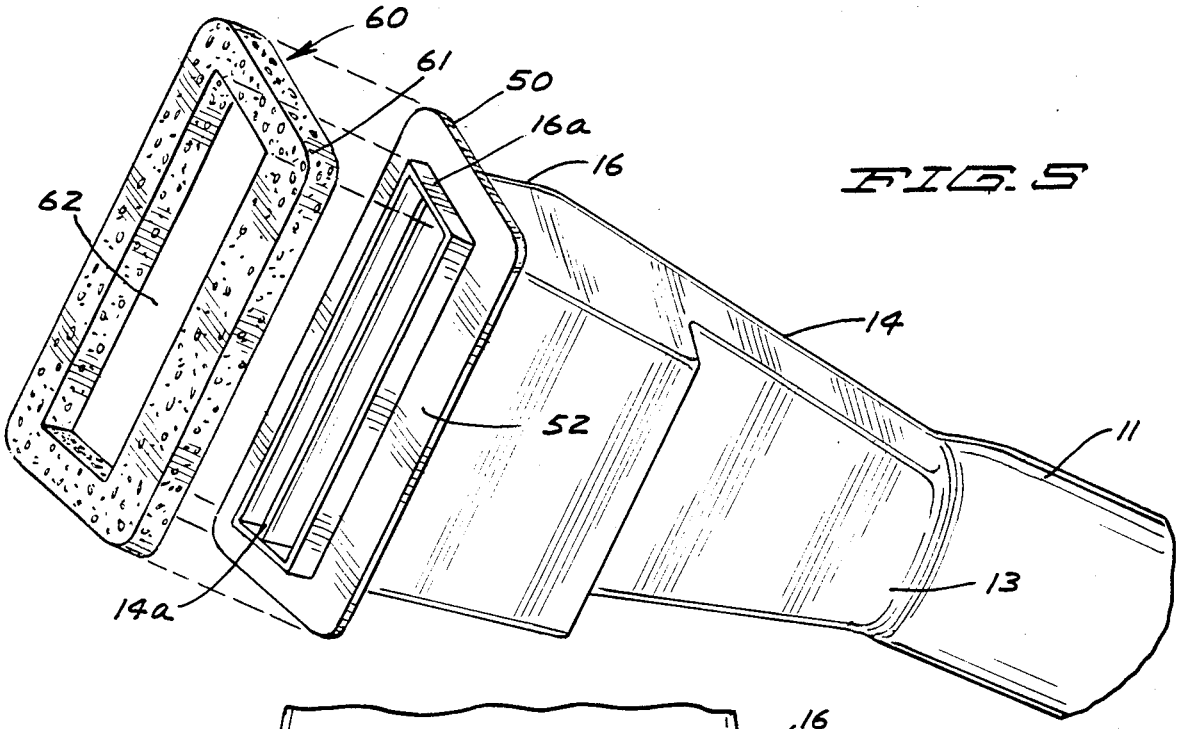
FIG. 5 is a broken view in perspective showing a portion thereof in an alternate position.
Figure 6:
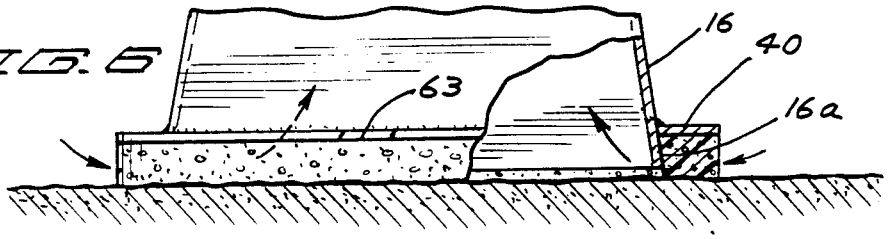
FIG. 6 is a broken view in vertical section showing a portion thereof broken away.
Figure 7:
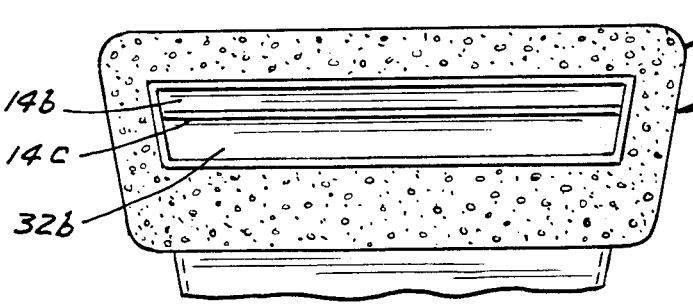
FIG. 7 is a broken view in bottom plan of the structure of FIG. 6.
Figure 8:
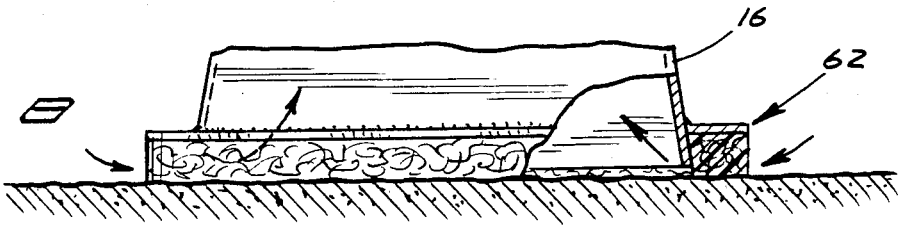
FIG. 8 is a view similar to that of FIG. 6 showing a modification.
Figure 9:
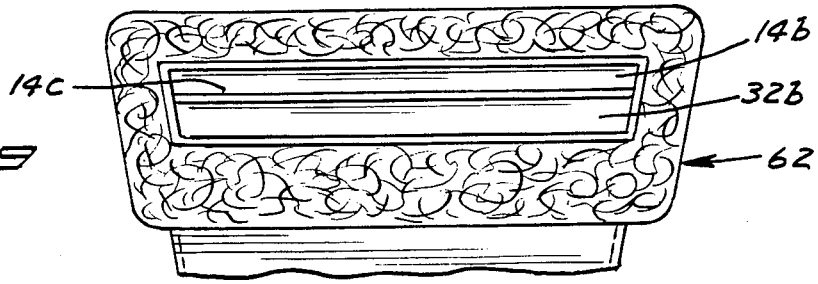
FIG. 9 is a broken view in bottom plan of the structure of FIG. 8.

The various seal members used, of which a representative number are shown for purpose of illustration, are of the general form as the seal 60 shown in FIG. 5. The seals as shown for illustration have a generally rectangular annular form 61 having a central cut out portion 62 to seat about the shoulder or projection 16*a*. Said seals will have preferably a self adhesive bottom surface 63 which will secure the seal in operating position and yet permit its removal for replacement.

The various seals will differ, as will be described, in the construction of their substance and in particular design.

In cleaning a porous surface such as carpeting, the vacuum in the chamber 14*b* pulls ambient air through the carpeting in recovering cleaning fluid from the cleaned surface. In this situation, with adequate air passing through the surface being cleaned, the seal 60 as in FIG. 5 need have but little porosity in its body 61 and its main function is to contain the cleaning fluid on the surface being cleaned with the motion of the cleaning apparatus. The seal 60 is a state of the art construction readily available in sheet form and is die cut to be seated upon the flange 50 having a center opening 62 to fit about the projecting collar 16*a*.

In cleaning a hard or fairly hard surface, unless the vacuum in the chamber 14*b* can readily withdraw the cleaning fluid being used, the cleaning fluid will collect and puddle and just be pushed about by the movement of the seal. However, a sufficient porosity in the structure of the seal, such as the seal 61, will avoid drawing against a dead air space and will permit the suction drawn on the chamber 14*b* to readily pull through the seal a sufficient flow of air to facilitate recovering the cleaning fluid being applied to the surface through the outlet 32*b* said cleaning fluid is thus recovered upon having been applied to the surface in a cleaning effort without gathering or puddling. Thus such a seal is very effectively used in cleaning a hard surface.

With reference to FIGS. 10–13, pads 64 and 65 are shown embodying well defined grooves or paths for the controlled admission of air. Said seals have bottom surface portions 64*a* and 65*a* having formed therein paths 64*b* and 65*c* respectively.

The seal 65 is shown having fairly wide spaced air paths 64*b* extending substantially transversely of the seal. Said seal 65 is shown to have a bottom surface portion having closely spaced fairly narrow V-grooved air paths transversely of said seal.

The seals 64 and 65 in having well defined bottom air paths may have fairly dense body structures and provide a good mixing of air and cleaning fluid in the cleaning effort and provide a good flow of air in the vacuuming effort.

In cleaning a very porous surface where an adequate supply of air is secured by passage of air being drawn through the material covering surface being cleaned, such as a porous rug, a dense seal may be used which will only permit air to enter from about its perimeter. In such a situation, it is desirable to use a seal, such as seal 66 which will stand considerable cleaning pressure having a dense body 66*a* and by having a rigid backing plate 66*b* which is secured to the modified flange 50 shown as 50' in FIG. 14, the same being apertured to receive bolts 66*c* which are secured extending through the plate 66*b*. A pair of nuts 68 will secure said bolts.

In doing an effective cleaning job, a balanced mix of air and cleaning fluid is required, as previously indicated, the movement of air serves as a very effective dispersing agent in effecting a thorough application of the cleaning fluid to the surface to be cleaned and in providing a live air chamber facilitating the recovery or withdrawal of cleaning fluid and soil or contaminants.

A balance or cooperation of air movement is achieved between the use of the adjustable air ports 46 and 47 for the entry of air accompanying the entry of cleaning fluid into the cleaning chamber 32*a* and the entry of air from about the perimeter of the seal being used in conjunction with the air being drawn through a porous surface being cleaned. The seals are particularly adapted as to their structure as not to collapse under the application of a vacuum being drawn upon them.

The experience of the operator is utilized to indicate the adjustment of the ports 46 and 47 taken in conjunction with the porosity of the seals being used and with the porosity or density of the surface covering material of the area being cleaned.

The structure herein as described is light in weight, has a convenient easy to operate control valve 26 and in demonstrations has shown very successful cleaning results.

It is seen that the partition 14*c* is spaced inwardly of the plane of the end of said nozzle 16 whereby there is a clear passage between the chamber 32*a* and the chamber 14*b*, the vacuum drawn upon said chamber 14*b* causes a forward acceleration of the cleaning fluid coming through the chamber 32*a*.

The operation of the cleaning head is believed to be well understood from the description given. It is moved with forwardly and rearwardly comfortable arm strokes in the customary manner of using such a piece of cleaning equipment.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. In connection with a surface covering material cleaning machine, a nozzle structure comprising a housing member substantially rectangular in transverse section having a vertically tapered forward terminal portion, said housing having a vacuum chamber and a cleaning chamber therein, a cleaning fluid line extending into said cleaning chamber, an adjustable air port into said cleaning chamber, a flange disposed about said terminal portion adjacent the end portion thereof, a seal member removably disposed to overlie said flange, said seal member being arranged and constructed as to provide therethrough a predetermined admission of air, and said admission of air being balanced with the air admitted through said port.

2. The structure of claim 1, wherein said seal member has passages formed in the bottom surface portion thereof.

3. The structure of claim 1, wherein said flange is substantially at a right angle relative to the plane of the surface adjacent thereto.

4. In connection with a surface covering material cleaning machine, a nozzle structure comprising a housing member having an upper and lower wall connected by side walls forming a vertically tapered terminal portion, a plate member underlying and being spaced below the forward portion of said lower wall, said plate member having side walls and a rear wall extending upwardly to be secured to said lower wall forming a part of said terminal portion, said plate member forming a chamber with said lower wall, a cleaning fluid line extending to said end wall and having a jet projecting into said chamber, an air port in said rear wall, means carried by said rear wall adjusting said air port, a plate member forming a flange about said terminal portion substantially at right angles to the walls thereof, a seal member of predetermined porosity overlying said flange, said seal member controlling the admission of air therethrough, and said air port being adjusted to balance with said air flow as admitted through said seal member relative to the porosity of surface material to be cleaned.

5. The structure of claim 4, wherein said housing has a vacuum chamber therein, and said seal member being of such structure as to withstand collapsing with a vacuum being drawn thereupon.

6. The structure of claim 4, wherein said seal member is removably secured to said flange.

7. The structure of claim 4, wherein said flange has said terminal portion projecting therethrough forming a collar, said seal member being disposed about said collar.

8. The structure of claim 4, wherein said seal member has air paths therein.

9. The structure of claim 4, wherein said seal member has grooves in the bottom portion thereof, said grooves being disposed to extend across said seal member.

10. The structure of claim 4, wherein said seal member has a rigid base portion of such density as to provide very limited access for admission of air therethrough.

11. The structure of claim 4, wherein said seal member has a rigid base portion of such density as to provide no access for admission of air therethrough.

* * * * *